US006554917B1

(12) United States Patent
Yamagami et al.

(10) Patent No.: US 6,554,917 B1
(45) Date of Patent: Apr. 29, 2003

(54) STEEL SHEET FOR HEAT SHRINK BAND EFFECTIVE FOR PREVENTING COLOR DRIFT

(75) Inventors: Nobuo Yamagami, Tokyo (JP); Kunikazu Tomita, Tokyo (JP); Yasuyuki Takada, Tokyo (JP); Yoshihiko Oda, Tokyo (JP); Chohachi Sato, Tokyo (JP); Teruo Takeuchi, Tokyo (JP); Ichiro Saito, Tokyo (JP); Hiroaki Kato, Tokyo (JP)

(73) Assignees: NKK Corporation, Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 09/744,139

(22) PCT Filed: May 28, 1999

(86) PCT No.: PCT/JP99/02856

§ 371 (c)(1),
(2), (4) Date: Mar. 19, 2001

(87) PCT Pub. No.: WO00/73526

PCT Pub. Date: Dec. 7, 2000

(51) Int. Cl.[7] ..... C22C 38/02; H01J 29/87
(52) U.S. Cl. ..... 148/320
(58) Field of Search ..... 148/320; 420/8

(56) References Cited

U.S. PATENT DOCUMENTS 5,094,920 A * 3/1992 Shiozaki et al. ..... 428/472.1
5,968,661 A * 10/1999 Saito et al. ..... 428/457

* cited by examiner

*Primary Examiner*—Roy King
*Assistant Examiner*—Harry D. Wilkins, III
(74) *Attorney, Agent, or Firm*—Frishauf, Holtz, Goodman & Chick, P.C.

(57) ABSTRACT

A steel sheet for preparing a heat shrink band effective for preventing the color drift is provided by a steel sheet having 24 kg/mm$^2$ or higher of yield stress and 400 or higher of the product between the permeability $\mu$ under a magnetic field of 0.3 Oe and the sheet thickness.

4 Claims, 2 Drawing Sheets

STEEL SHEET FOR HEAT SHRINK BAND EFFECTIVE FOR PREVENTING COLOR DRIFT

This application is the United States National Phase Application under 35 USC 371 of International Application PCT/JP99/02856 (not published in English) filed May 28, 1999.

TECHNICAL FIELD

The present invention relates to a steel sheet used for preparing a heat shrink band for fastening the periphery of a panel portion in a color cathode ray tube such as a television receiver, particularly, to a steel sheet for a heat shrink band that is effective for preventing the color drift.

BACKGROUND ART

In a color cathode ray tube, the inner space of the tube is held at a high vacuum state of $1.0\times10^{-7}$ Torr. Therefore, in order to prevent the deformation of the panel face and the implosion of the tube body, a heat shrink band made of a steel sheet that is formed into a band is arranged in the periphery of the panel portion so as to impart tension to the periphery of the panel portion and, thus, to correct the deformation of the panel face.

Further, the heat shrink band performs the function of shielding the geomagnetism as well as the function of shielding the internal magnetism so as to prevent the landing position of the electron beam on the phosphor screen from being deviated by the geomagnetism. In other words, the heat shrink band also performs the function of preventing the color drift.

A soft steel sheet has been used for preparing the heat shrink band. However, in the case of using a soft steel sheet, the geomagnetic drifting properties are relatively large, leading to a low degree of allowance in respect of the color drift inhibition. Such being the situation, it is strongly required to develop a material capable of effectively preventing the color drift.

DISCLOSURE OF THE INVENTION

An object of the present invention is to provide a steel sheet for preparing a heat shrink band small in the geomagnetic drift and effective for preventing the color drift while maintaining tension favorably comparable with that of the conventional steel sheet.

According to an aspect of the present invention, there is provided a steel sheet for preparing a heat shrink band effective for preventing the color drift, wherein said steel sheet has 24 kg/mm$^2$ or higher of yield stress and at least 400 or higher of the product between the permeability $\mu$ under a magnetic field of 0.3 Oe and the sheet thickness.

According to another aspect of the present invention, there is provided a steel sheet for preparing a heat shrink band effective for preventing the color drift, wherein said steel sheet contains 0.005% by weight or less of C, 0.005% by weight or less of N, 0.1% by weight or less of P, 0.02% by weight or less of S, 0.2 to 3.0% by weight of Si, 1.0% by weight or less of Mn, and 1.0% by weight or lsess of sol. Al, and has 24 kg/mm$^2$ or higher of yield stress and 400 or higher of the product between the permeability $\mu$ under a magnetic field of 0.3 Oe and the sheet thickness.

As a result of an extensive research conducted in an attempt to achieve the objects noted above, the present inventors have found that:

(1) The color drift can be improved, if the product $\mu\times t$ of the raw material steel sheet for a band is 400 or higher, where $\mu$ represents the permeability under an external magnetic field intensity of 0.3 Oe, which is equal to the geomagnetic level, and t represents the thickness of the steel sheet; and that:

(2) It is necessary to add 0.2% by weight or higher of Si to the steel sheet raw material in order to allow the steel sheet to exhibit strength equal to or higher than that of the conventional steel sheet while maintaining the permeability noted above.

The present invention has been achieved on the basis of these findings.

BEST MODE OF WORKING THE INVENTION

The present invention will now be described in detail.

The present invention has been achieved on the basis of various experiments described below:

1. Relationship Between Color Drift and Permeability

Figure 1:
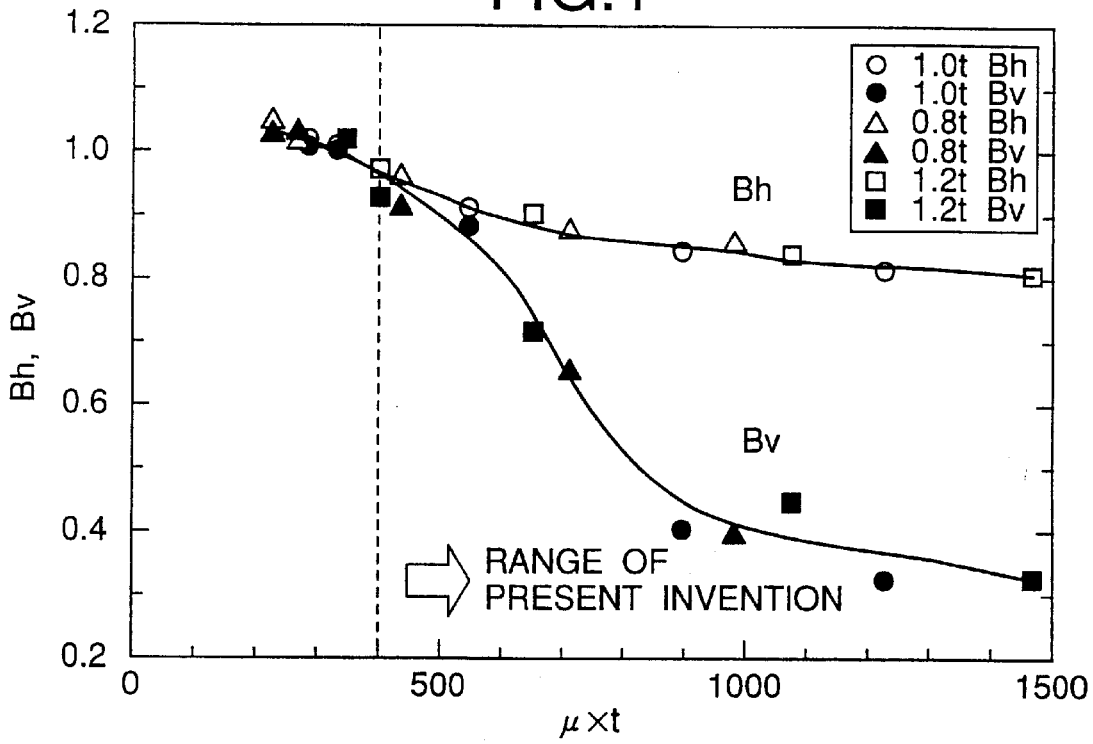
FIG. 1 is a graph showing the relationship between the product $\mu\times t$, where $\mu$ represents the permeability under a magnetic field of 0.3 Oe and t represents the thickness of the steel sheet, and the geomagnetic drifting properties.

A steel containing 0.003% by weight of C, 1.35% by weight of Si, 0.20% by weight of Mn, 0.05% by weight of P, 0.003% by weight of S, 0.20% by weight of Al, and 0.002% by weight of N was melted in a laboratory and, then, subjected to a hot rolling, followed by applying a cold rolling to 0.8 to 1.2 mmt. Then, annealing was applied to the steel at 500° C. to 800° C. for 90 seconds, followed by processing the steel to prepare a band of a predetermined shape. The resultant band was heated to 500° C. and, then, fitted over the panel of a 29-inch TV cathode ray tube so as to evaluate the geomagnetic drifting properties. FIG. 1 is a graph showing the results.

For comparison, a similar experiment was applied to a conventional soft steel containing 0.035% by weight of C, 0.02% by weight of Si, 0.20% by weight of Mn, 0.03% by weight of P, 0.01% by weight of S, 0.02% by weight of Al, and 0.0027% by weight of N. Specifically, the conventional soft steel was similarly melted, subjected to a hot rolling and, then, subjected to a cold rolling to 1.2 mmt, followed by applying an annealing to 600° C. Further, after processing of the soft steel into a band, a shrink fitting was applied under the similar conditions so as to evaluate the geomagnetic drifting properties. FIG. 1 also shows the results.

Plotted on the abscissa of the graph shown in FIG. 1 is the product $\mu \times t$, where $\mu$ represents the permeability under an external magnetic field of 0.3 Oe, which corresponds to the geomagnetism, and t represents the thickness of the steel sheet. The product $\mu \times t$ was measured after a ring test piece taken from the annealed steel sheet before the shrink fitting step was subjected to a heat treatment corresponding to the shrink fitting.

On the other hand, the drifting amounts Bh, Bv in the landing point of the electron beam are plotted on the ordinate of the graph. To be more specific, a CRT (Cathode Ray Tube) was rotated by 360° with a vertical magnetic field of 0.35 Oe and a horizontal magnetic field of 0.30 Oe kept applied to the CRT so as to measure the landing error of the electron beam relative to the reference point of the landing point. The peak-to-peak value of the landing error was plotted in the graph as a horizontal drifting amount Bh. Also, the landing error in the case where the horizontal magnetic field was set at 0 Oe and the vertical magnetic field was changed from 0 Oe to 0.35 Oe was measured as the vertical drifting error Bv. Incidentally, the drifting amount of the landing error plotted on the ordinate is denoted by a relative value with the value of the conventional soft steel set at 1.

As apparent from FIG. 1, each of Bh and Bv tends to be decreased with increase in the product $\mu \times t$, supporting that the color drift caused by the geomagnetism can be improved by increasing the product $\mu \times t$. It is specified in the present invention that the value of the product $\mu \times t$ is 400 or higher. In this case, both the horizontal drifting amount Bh and the vertical drifting amount Bv are smaller than those of the conventional steel in which the product $\mu \times t$ is 400 or higher, as apparent from FIG. 1.

2. Relationship Among Si Content, Geomagnetic Drifting Amount and Strength

Figure 2:
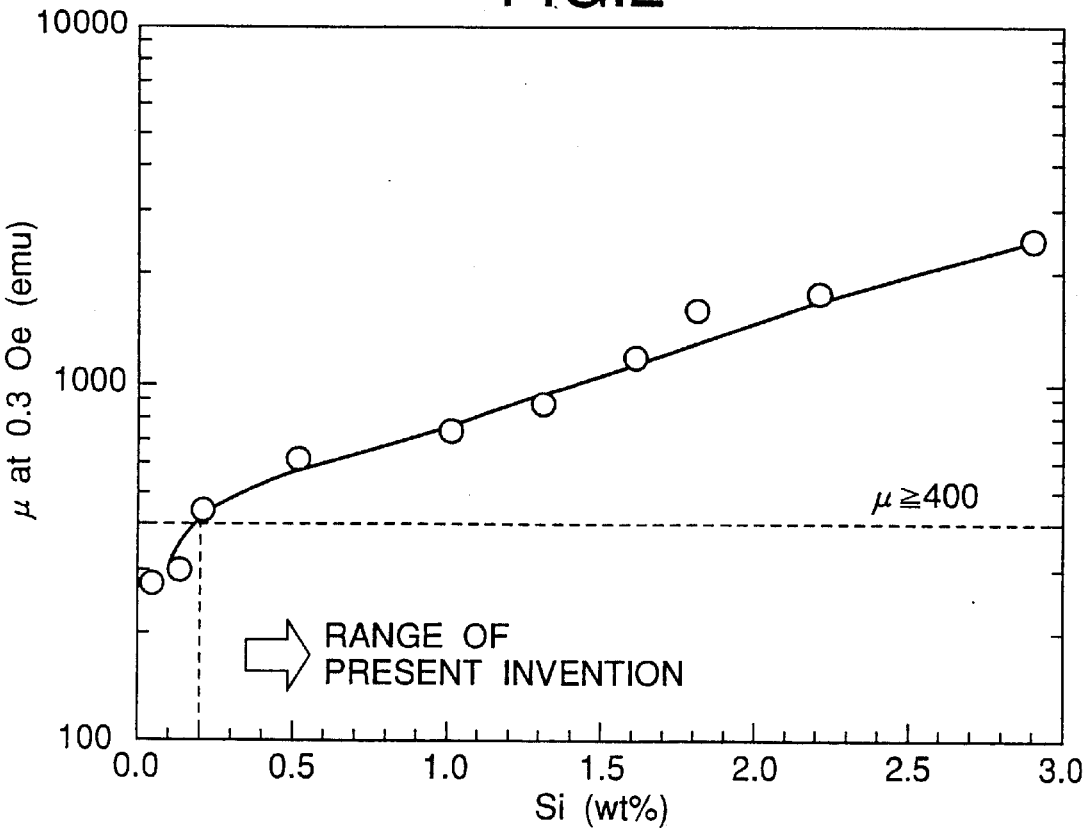
FIG. 2 is a graph showing the relationship between the Si content of the steel sheet and the permeability $\mu$ under a magnetic field of 0.3 Oe.
Figure 3:
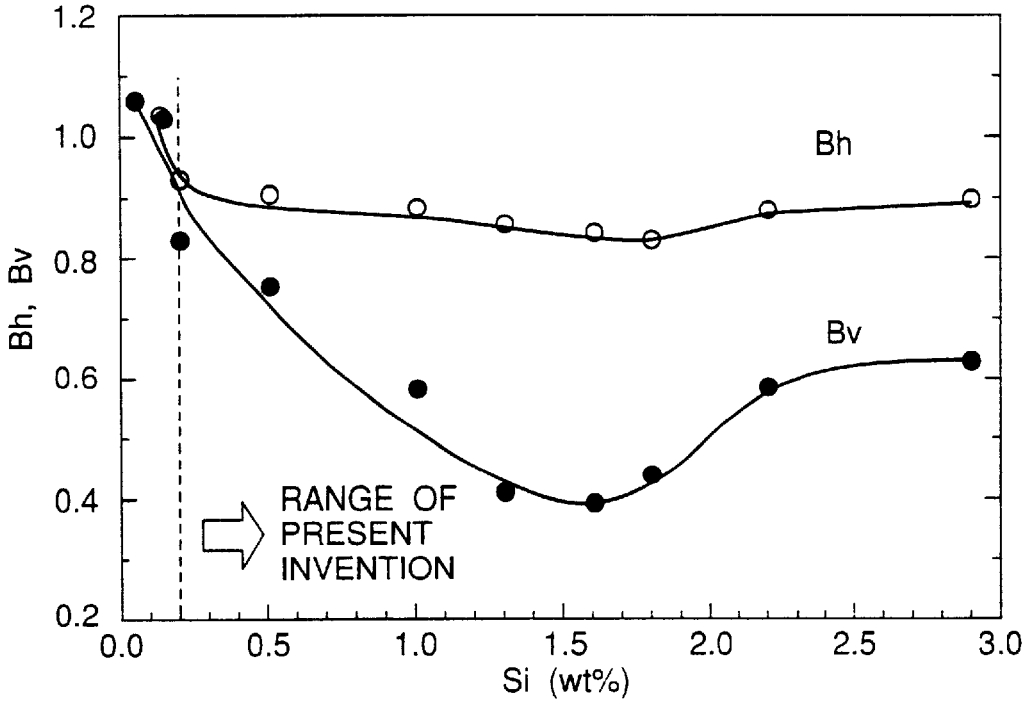
FIG. 3 is a graph showing the relationship between the Si content of the steel sheet and the geomagnetic drifting properties.

FIG. 2 is a graph showing the change in the permeability of a band material of 1.0 mmt under a magnetic field of 0.3 Oe in the case where the Si content was changed, said band material containing 0.002% by weight of C, 0.24% by weight of Mn, 0.02% by weight of P, 0.003% by weight of S, 0.22% by weight of Al, 0.0028% by weight of N and a varied amount of Si. Also, FIG. 3 is a graph showing the change in the geomagnetic drifting amount in the case of changing the Si content of the band material. As apparent from FIGS. 2 and 3, the permeability of the material is increased with increase in the Si content until the Si content is increased to reach 2% by weight, leading to reduction in the geomagnetic drifting amount. Particularly, where the Si content is 0.2% by weight or higher, the geomagnetic drifting amount is much smaller than that for the conventional steel. If the Si content is further increased to exceed 2% by weight, the permeability is certainly increased. However, it is impossible to decrease the geomagnetic drifting amount. The reason for the incapability of decreasing the geomagnetic drifting amount has not yet been clarified. However, it is considered reasonable to understand that the high temperature strength of the steel material for the band is increased with increase in the Si content so as to change the adhesion properties between the band and the panel, leading to a failure to decrease the geomagnetic drifting amount.

To be more specific, if the Si content of the steel is increased, the high temperature strength is increased because of the strengthening of the Si solid solution so as to increase the band tension under high temperatures. If the band exhibits a high strength when the band is shrunk in the cooling step of the shrink fitting so as to begin to fasten the panel, the shape of the band deformed by the uneven accuracy in the processing, the uneven heating temperature, etc. tends to be frozen. In this case, the band fails to be adhered to the entire panel even if the band is cooled to room temperature. As a result, it is impossible to achieve a sufficient magnetic shielding, leading to a failure to decrease the magnetic drifting amount in spite of the increase in the permeability.

Figure 4:
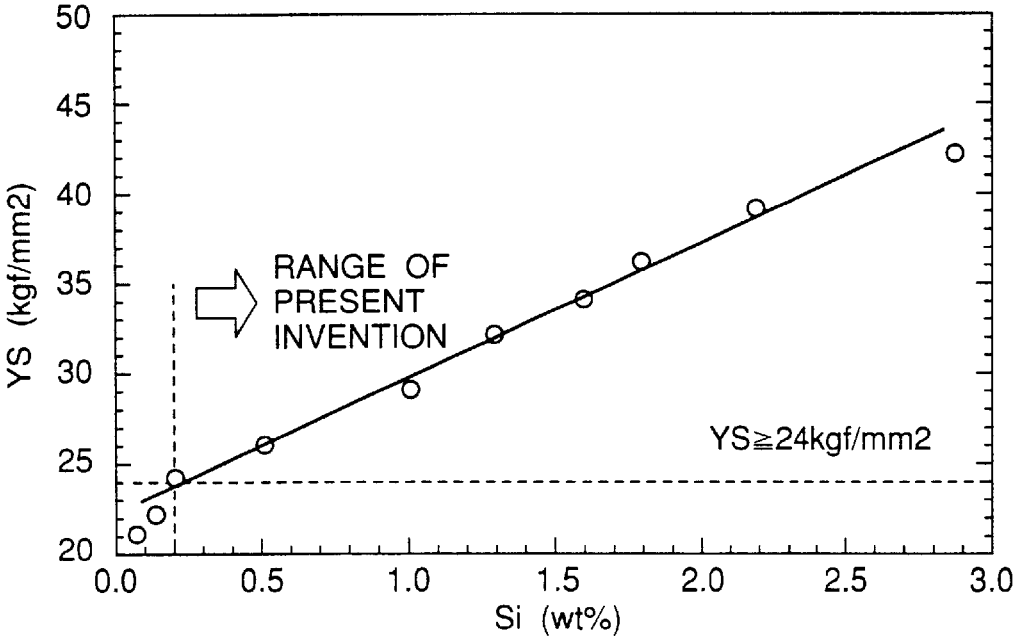
FIG. 4 is a graph showing the relationship between the Si content of the steel sheet and the yield stress (YS).

Further, FIG. 4 is a graph showing the relationship between the yield strength of the steel described above and the Si content. As apparent from the graph, the yield strength is increased with increase in the Si content. To be more specific, if Si is added in an amount of 0.2% by weight or higher, the yield strength is rendered 24 kgf/mm$^2$ or higher, which is the yield strength for the conventional steel.

The findings (1) and (2) described previously are based on the experimental data described above and constitute the basis of the present invention.

In the present invention, the yield stress of the steel sheet is defined to be 24 kg/mm$^2$ or higher and the product between the permeability $\mu$ under a magnetic field of 0.3 Oe and the sheet thickness is defined to be 400 or higher, making it possible to provide a steel sheet capable of effectively preventing the color drift while maintaining a strength equivalent to that of the conventional steel sheet. Preferably, the steel sheet of the present invention contains 0.005% by weight or less of C, 0.005% by weight or less of N, 0.1% by weight or less of P, 0.02% by weight or less of S, 0.2 to 3.0% by weight of Si, 1.0% by weight ot less of Mn, and 1.0% by weight or less of sol. Al. The reasons for the preferred ranges of these components will now be described.

Specifically, silicon (Si) is the most important component in the present invention. The Si addition makes it possible to increase the permeability while increasing the strength by the strengthening of the solid solution. Where Si is added in an amount of 0.2% by weight or higher, the strength·permeability balance is rendered excellent so as to provide the strength·permeability equal to or higher than that of the conventional steel. If Si is added in an amount exceeding 3% by weight, however, the workability is markedly impaired. Naturally, it is desirable for that the Si content is equal to or less than 3% by weight. Incidentally, in view of the color drift, it is more desirable for the Si content to fall within a range of between 1% and 2%. If the Si content falls within the range noted above, the color drifting amount can be markedly decreased.

Carbon (C), which contributes to the strengthening of the steel sheet, is not desirable in terms of the permeability. In order to prevent the adverse effect on the permeability, it is desirable for the C content to be 0.005% by weight or less.

Manganese (Mn) serves to improve the hot ductility of the steel sheet. In order to improve the hot ductility, it is desirable to add Mn in an amount of 0.1% by weight or higher. If the Mn content exceeds 1.0% by weight, however, the permeability of the steel sheet is deteriorated. Therefore, it is desirable to add Mn in amount of 1.0% by weight or less.

Phosphorus (P) also contributes to the strengthening of the steel sheet and, thus, it is possible to add P as desired. If the P content exceeds 0.2% by weight, however, the steel sheet is rendered brittle, giving rise to the problem that, for example, the coil breakage takes place in the cold rolling step. Naturally, it is desirable that the P content is equal to or less than 0.2% by weight.

Sulfur (S) is not desirable in terms of both the hot ductility and the permeability. In order to prevent an adverse effect on these properties, it is desirable for that the S content is equal to or less than 0.02% by weight.

Sol. Al (aluminum) deteriorates the workability. In order to prevent the adverse effect produced by sol. Al, it is desirable for that the sol. Al content is equal to or less than 1.0% by weight.

Further, nitrogen (N), which certainly contributes to the strengthening of the steel sheet, is not desirable in terms of the permeability, like C. In order to prevent the adverse effect on the permeability, it is desirable for that the N content is equal to or less than 0.005% by weight.

Incidentally, plating is applied in some cases to the heat shrink band in order to improve the corrosion resistance of the band. Even in this case, desired properties can be obtained as far as the properties of the band before the plating fall within the ranges specified in the present invention.

EXAMPLES

Ingots of steel samples shown in Table 1 were heated again to 1200° C. and, then, subjected to a hot rolling at a finishing temperature of 820° C. and a coiling temperature of 680° C. so as to obtain steel sheets each having a thickness of 3.2 mm. Each of the resultant hot rolled sheets was subjected to acid pickling and, then, subjected to a cold rolling until the sheet thickness was decreased to 0.8 to 1.2 mm, followed by applying an annealing treatment at 700° C. for 90 seconds. Further, a heat treatment was applied to each of these steel sheets at 500° C., which corresponds to the heat shrinking temperature, for 5 seconds, followed by air cooling to room temperature so as to measure the yield stress and the DC magnetic properties, i.e., the permeability at 0.3 Oe and the coercive force when excited to 0.5T. Still further, the steel sheet annealed at 700° C. was processed into a band of a predetermined shape, and the band thus prepared was heated to 500° C. and, then, fitted over the panel of a 29-inch TV cathode ray tube so as to evaluate the geomagnetic drifting properties. Table 2 shows the results. Incidentally, "Bh" in Table 2 represents the horizontal drifting amount, with "Bv" representing the vertical drifting amount. As described previously, each of Bh and Bv is denoted by a relative value with the value for the conventional soft steel set at 1.

Steel samples A to E shown in Tables 1 and 2, which have components falling within the preferred ranges described above, constitute steels of the present invention meeting the requirements in respect of the yield stress YS and the product $\mu \times t$ specified in the present invention, i.e., YS≧24 kgf/mm$^2$ and $\mu \times t \geqq 400$. It has been confirmed that these samples A to E exhibit values of the geomagnetic drifting properties smaller than those for the conventional soft steel. On the other hand, steel samples F to H, which have components failing to fall within the preferred ranges noted above, constitute comparative steels having any of the yield stress and the permeability failing to fall within the ranges specified in the present invention. It has been confirmed that the geomagnetic drifting properties of these comparative steels are substantially equal to those of steel sample I, which represents the conventional soft steel, failing to satisfy sufficiently the characteristics required for the heat shrink band for a cathode ray tube.

TABLE 1

(wt %)

| steel sample | C | Si | Mn | P | S | sol. Al | T.N. | |
|---|---|---|---|---|---|---|---|---|
| A | 0.0030 | 1.41 | 0.2 | 0.05 | 0.003 | 0.25 | 0.0010 | present invention |
| B | 0.0025 | 1.86 | 0.22 | 0.04 | 0.03 | 0.30 | 0.0015 | |
| C | 0.0025 | 2.75 | 0.24 | 0.08 | 0.003 | 0.31 | 0.0025 | |
| D | 0.0033 | 1.08 | 0.2 | 0.04 | 0.004 | 0.25 | 0.0022 | |
| E | 0.0021 | 0.25 | 0.55 | 0.08 | 0.003 | 0.45 | 0.0014 | |
| F | 0.0019 | 0.12 | 0.15 | 0.05 | 0.002 | 0.22 | 0.0022 | comparative steel |
| G | 0.0065 | 1.27 | 0.37 | 0.03 | 0.004 | 0.35 | 0.0027 | |
| H | 0.0033 | 1.33 | 0.31 | 0.09 | 0.004 | 0.55 | 0.0068 | |
| I | 0.0350 | 0.02 | 0.2 | 0.03 | 0.01 | 0.02 | 0.0027 | conventional steel |

TABLE 2

| steel sample | sheet thickness (mm) | $\mu \times t$ | coercive force (Oe) | Bh | Bv | yield stress (kgf/mm$^2$) | |
|---|---|---|---|---|---|---|---|
| A | 1.0 | 920 | 0.95 | 0.88 | 0.41 | 35.1 | steel of |
| B | 0.8 | 1220 | 0.76 | 0.89 | 0.49 | 37.1 | present invention |
| C | 0.8 | 2120 | 0.51 | 0.91 | 0.65 | 41.2 | |

TABLE 2-continued

| steel sample | sheet thickness (mm) | $\mu \times t$ | coercive force (Oe) | Bh | Bv | yield stress (kgf/mm$^2$) | |
|---|---|---|---|---|---|---|---|
| D | 1.0 | 780 | 1.09 | 0.89 | 0.59 | 29.1 | |
| E | 1.2 | 450 | 1.28 | 0.91 | 0.85 | 24.5 | |
| F | 1.2 | 290 | 1.78 | 1.02 | 1.00 | 22.9 | comparative steel |
| G | 1.0 | 345 | 1.49 | 0.99 | 0.99 | 36.9 | |
| H | 1.0 | 350 | 1.56 | 0.99 | 0.98 | 32.1 | |
| I | 1.2 | 233 | 1.85 | 1.00 | 1.00 | 24.2 | convention steel |

What is claimed is:

1. A steel sheet for preparing a heat shrink band effective for preventing a color drift, wherein said steel sheet contains 0.5 to 3.0% by weight of Si; has 24 kg/mm$^2$ or higher of yield stress; and wherein the product $\mu \times t$=600 mm or higher where $\mu$ is the permeability under a magnetic field of 0.3 Oe and t is the sheet thickness.

2. A steel sheet for preparing a heat shrink band effective for preventing a color drift, wherein said steel sheet contains 0.005% by weight or less of C, 0.005% by weight or less of N, 0.1% by weight or less of P, 0.02% by weight or less of S, 0.5 to 3.0% by weight of Si, 1.0% by weight or less of Mn, and 1.0% by weight or less of sol. Al; has at least 24 kg/mm$^2$ of yield stress; and wherein the product $\mu \times t$=600 mm or higher where $\mu$ is the permeability under a magnetic field of 0.3 Oe and t is the sheet thickness.

3. A steel sheet for preparing a heat shrink band effective for preventing a color drift, wherein said steel sheet contains 0.3 to 3.0% by weight of Si; has 24 kg/mm$^2$ or higher of yield stress; and wherein the product of $\mu \times t$ is higher than 780 mm where $\mu$ is the permeability under a magnetic field of 0.3 Oe and t is the sheet thickness.

4. A steel sheet for preparing a heat shrink band effective for preventing a color drift, wherein said steel sheet contains 0.005% by weight or less of C, 0.005% by weight or less of N, 0.1% by weight or less of P, 0.02% by weight or less of S, 0.3 to 3.0% by weight of Si, 1.0% by weight or less of Mn, and 1.0% by weight or less of sol. Al; has at least 24 kg/mm$^2$ of yield stress; and wherein the product of $\mu \times t$ is higher than 780 mm where $\mu$ is the permeability under a magnetic field of 0.3 Oe and t is the sheet thickness.

* * * * *

UNITED STATES PATENT AND TRADEMARK OFFICE

CERTIFICATE OF CORRECTION

PATENT NO. : 6,554,917 B1
DATED : April 29, 2003
INVENTOR(S) : Yamagami et al.

It is certified that error appears in the above-identified patent and that said Letters Patent is hereby corrected as shown below:

Title page,
Item [56], References Cited, after U.S. PATENT DOCUMENTS, insert the following:
-- FOREIGN PATENT DOCUMENTS

| | | |
|---|---|---|
| 10-214578 A | 8/1998 | Japan |
| 3-87313 A | 4/1991 | Japan |
| 8-6134 B | 1/1996 | Japan |
| 11-209848 A | 8/1999 | Japan --. |

Signed and Sealed this

Third Day of May, 2005

JON W. DUDAS
*Director of the United States Patent and Trademark Office*